US006159062A

United States Patent [19]

Taylor, Jr.

[11] Patent Number: 6,159,062

[45] Date of Patent: Dec. 12, 2000

[54] HIGH PERFORMANCE BOAT PROP GUARD

[76] Inventor: Guy Taylor, Jr., P.O. Box 164, Duchesne, Utah 84021

[21] Appl. No.: 09/343,302

[22] Filed: Jun. 30, 1999

Related U.S. Application Data

[63] Continuation of application No. 09/153,656, Sep. 15, 1998, abandoned, which is a continuation of application No. 08/842,497, Apr. 24, 1997, abandoned.

[51] Int. Cl.[7] ..... B63H 5/16

[52] U.S. Cl. ..... 440/71

[58] Field of Search ..... 440/66, 67, 71, 440/72, 900; D15/4

[56] References Cited

U.S. PATENT DOCUMENTS

| | | | |
|---|---|---|---|
| D. 322,074 | 12/1991 | Hansen | D15/4 |
| 711,884 | 10/1902 | Sjostrom . | |
| 945,553 | 1/1910 | Kovacs . | |
| 2,135,162 | 11/1938 | Benson | 115/42 |
| 2,244,217 | 6/1941 | Pries | 115/42 |
| 2,551,371 | 5/1951 | Grigg | 115/17 |
| 2,800,150 | 7/1957 | Farwell, Sr. | 440/72 |
| 2,963,000 | 12/1960 | Fester | 115/42 |
| 2,983,246 | 5/1961 | Manley | 115/42 |
| 3,508,517 | 4/1970 | Hannan | 440/67 |
| 3,658,028 | 4/1972 | Koons | 440/67 |
| 3,899,992 | 8/1975 | Fuller | 440/67 |
| 4,078,516 | 3/1978 | Balius | 115/42 |
| 4,240,251 | 12/1980 | Fuller | 440/71 |
| 4,565,533 | 1/1986 | Springer | 440/71 |
| 4,637,801 | 1/1987 | Schultz | 440/67 |
| 4,680,017 | 7/1987 | Eller | 440/66 |
| 4,773,347 | 9/1988 | Winterbottom | 440/67 |
| 4,838,819 | 6/1989 | Todorovic | 440/47 |
| 5,098,321 | 3/1992 | Taylor, Jr. | 440/67 |

FOREIGN PATENT DOCUMENTS

| | | | |
|---|---|---|---|
| 2096099 | 2/1972 | France . | |
| 58558 | 9/1891 | Germany . | |
| 8902672 | 6/1989 | Germany . | |
| 147473 | 10/1954 | Sweden | 440/71 |
| 2213788 | 8/1989 | United Kingdom | 440/71 |

OTHER PUBLICATIONS

"Transmittal of Final Report Produced Under Boating Safety Grant No. 1702.04," Coast Guard Report, U.S. Department of Transportation, United States Coast Guard (Mar. 10, 1999).

*Primary Examiner*—Ed Swinehart
*Attorney, Agent, or Firm*—Madson & Metcalf

[57] ABSTRACT

A propeller guard including a multi-angled band formed of a plurality of independently radiused sections. The band may also include a plurality of evenly spaced ports therethrough. The multi-angled band is designed to improve the performance characteristics, specifically acceleration, planing, speed and steering, of the motor. The band is attached to the motor by an attachment bracket which is designed to inhibit fatigue and cyclical loading failure caused by vibrations of the band during use. The band may also include convex tapered inlet and outlet openings.

20 Claims, 4 Drawing Sheets

HIGH PERFORMANCE BOAT PROP GUARD

This application is a continuation of application Ser. No. 09/153,656, filed Sep. 15, 1998, now abandoned which is a continuation of application Ser. No. 08/842,497, filed Apr. 24, 1997 now abandoned.

BACKGROUND OF THE INVENTION

1) Field of the Invention

The present invention relates generally to guard members for shielding the propeller of an outboard motor. More specifically, the present invention relates to a propeller guard which is designed for maximizing the performance characteristics of an outboard motor.

2) Prior Art

The propeller of an outboard motor typically rests below the bottom surface of the boat when in use, and propels the boat through the water. Due to its position during operation, the propeller tends to be very suspectable to damage from under water objects such as rocks, sandbars, marine life and the like. If the propeller becomes damaged due to its impingement on underwater objects, it may become unable to perform as designed. The need for repair and/or replacement of a propeller damaged thus generally occurs at very inconvenient times and is always very expensive. Therefore, a need exist to develop a guard which can protect the propeller of an outboard motor and prevent its being damaged by underwater objects.

Also, the propeller of an outboard motor spins at an extremely high RPM during use. Should a passenger, skier, swimmer or other person be accidentally hit by the propeller during operation of the motor, serious injury will inevitably result. Therefore, a guard which will inhibit accidental contact of a person with the propeller to prevent accidental bodily injury is also needed.

Many prior art attempts have been made to solve the above problems. Several prior art devices which are representative of the many previous attempts to develop a prop guard responding to the above-identified needs are shown in U.S. Pat. No. 2,551,371 to Grieg; U.S. Pat. No. 2,963,000 to Fester; U.S. Pat. No. 2,983,246 to Manley; and, U.S. Pat. No. 4,078,516 to Balius. In each of these devices, an enclosure, generally including a hollow cylindrical member, is attached to the outboard motor so as to surround the propeller. The devices are designed to allow water to have fluid flow access to the propeller in order to allow the propeller to function as designed. Although these devices are somewhat successful in preventing damage to the propeller by preventing contact of the propeller with underwater objects, several severe drawbacks nevertheless remain. Most importantly, each of these devices tend to severely reduce the performance characteristics of the outboard motor.

As is well understood, an outboard motor pushes a boat forward in reaction to the propellers of the motor forcing water backwards. However, an outboard motor which also includes a propeller guard is inhibited in its performance due to the fact that water flowing past the propeller tends to be blocked or directed away from the propeller by the guard. Also, water impinging on the guard during operation of the motor increases the drag characteristic thereof, thus decreasing performance. Further, the presence of the guard, since not necessarily designed as an integral part of the motor, can cause instability, vibrations, control degradation, and unpredictability of motor response during use. Finally, prior art propeller guards are attached to the motor in such a manner as to be incapable of preventing damage or failure of the attachment members during high speed use. Accordingly, it is needful that a propeller guard be developed and designed which affords protection against contact between the propeller and underwater objects, and which at the same time is designed so as to maintain or improve motor performance characteristics such as steering, top end speed, planing, acceleration, and durability.

U.S. Pat. No. 4,680,017 to Eller, attempts to address the problem of maintaining and/or improving performance characteristics of the motor through the design of a propeller guard. The propeller guard of the Eller invention functions to prevent radial dissipation of water passing through the propeller, to thereby cause all water to be directed in a linearly rearward direction as it passes through the propeller. The intent is to ensure that all the water passing through the guard is useful in generating forward motion of the boat. However, in operation, the drag characteristics of Eller's propeller guard tend to off-set any advantages of its use. Further, control characteristics of Eller's motor are significantly degraded due to the presence and design of Eller's propeller guard.

U.S. Pat. No. 5,098,321 to Taylor, Jr., a co-inventor of the present application, also attempts to address the problem of maintaining and/or improving performance characteristics of the motor through the design of a propeller guard. The Taylor, Jr. invention includes many improvement over prior propeller guards in this respect including the use of a series of evenly spaced openings around the ring portion of the guard which are formed to allow water to pass therethrough during operation so as to increase the water volume passing the propeller and to avoid cavitation during turning. The present invention builds upon the design features in the Taylor, Jr. invention to further improve fluid flow past the propeller. Increase water pressure at the propeller plate surfaces, prevent cavitation due to the presence of the propeller guard, and improve steering, top end speed, planing, acceleration, and durability of the motor.

OBJECTS AND SUMMARY OF THE INVENTION

It is a principle object of the present invention to provide a propeller guard for an outboard motor which is designed to maintain or improve the performance characteristics of the motor.

It is also a principle object of the present invention to provide a propeller guard for an outboard motor which can prevent inadvertent contact of underwater objects with the motor propeller during use.

It is another object of the present invention to provide a propeller guard which improves the control characteristics such as planing, top speed, acceleration, steering, and durability of the outboard motor.

It is further an object of the present invention to design a propeller guard which is simple to manufacture and therefore relatively inexpensive, yet durable and reliable in use.

These and other objects of the present invention are realized in a specific embodiment of a propeller guard, described herein by way of example and not limitation, which includes a band forming a circumference around the motor propeller over which it is attached. The band may include a small concave attachment plate at one position thereabout and an attachment bracket diametrically opposed thereto. The attachment plate and bracket allow the band to be securely attached to the outboard motor at the bottom of the motor's anti-ventilation fin and at the bottom end of the motor's lower fin respectively.

The circumference of the band is preferably formed in a series of sections having alternating radius lengths, including infinitely radiused (completely flat) sections if desired, which function to diminish the bands drag and vibration characteristics while at the same time channel fluid toward the propeller at all steering positions thereof, to increase fluid pressure of the propeller, reduce or eliminate cavitation, and thus improve the performance characteristics of the motor. The band is secured to the motor with the aid of an attachment bracket which is preferably designed to minimize vibrations and other cyclical loading thereon in order to prevent premature metal fatigue, cracking, or failure.

In one embodiment of the invention, the band is formed with a convex tapper on the interior side of its inlet opening and a similar convex tapper on the exterior side of its outlet opening. The band may also include a series of ports positioned around the circumference thereof. The ports allow the water passing over the band's exterior surface to be diverted, by vacuum force, toward the propeller as the band passes through the water. Water passing over the interior surface of the band is accelerated due to the convex ("wing-like") shape of the inlet opening thereof, and causes a vacuum like effect through the ports which pulls water through the ports (from the exterior of the ring to the interior thereof) as the guard passes through the water. The ports are preferably oriented around the band in a generally uniform manner and formed through the band in a manner which causes the water passing therethrough to be given a slight radial component of flow. The size, number and general distribution of the ports about the band are calculated to cause a sufficient radial flow of water to increase control and steerability of the motor. At the same time, the port placement is also predetermined to avoid cavitation during a sharp turn which may be caused by water flow blockage by the band when the band moves into the flow path of the water passing the motor.

The above and other objects and advantages of the present invention are realized in a presently preferred embodiment thereof, shown and described by way of example and not by way of limitation, and the following detailed description of the invention and the drawings, in which similar structure is identified with similar numbers throughout

DETAILED DESCRIPTION OF THE INVENTION

Figure 2:
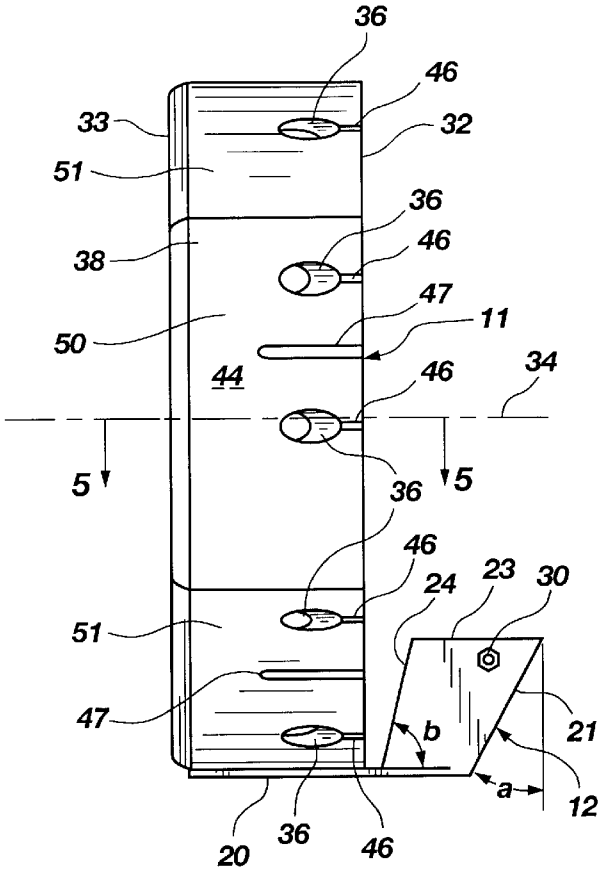
FIG. 2 is a side view of the propeller guard formed in accordance with the principles of the present invention.

The prop guard 10 of the present invention is adapted for use on motor boats having either an outboard motor 13 (as shown in dashed lines in FIG. 1), or an inboard/outboard motor (not shown). The motor includes a propeller 14 having blades 15 which are operatively connected inside motor 13 to a conventional type drive. The prop guard 10 of the present invention is attached to the motor 13 at a position on the underside of the motor 13 cavitation plate 16 by an attachment plate 18, and to a lower fin 17 of the motor 13 by an attachment bracket 12, in a manner substantially similar to the prop guard described in the above-mentioned U.S. Pat. No. 5,098,321 to Taylor, Jr., which is incorporated herein by reference in its entirety.

The prop guard 10 of the present invention is shown for purposes of illustration as being attached to a typical outboard motor 13, such as an 88–90 Merc and Mariner 100–115 hp outboard motor. It is well within the scope of the present invention however to attach the prop guard 10 to any size or type of outboard or inboard/outboard motor. Dimensions given herein below therefore are given for the purposes of describing the shown preferred embodiment only, and are not given by way of limitation of the general invention. It should be understood that the particular dimensions identified are relative to the above-mentioned motor and therefore would likely be modified should the prop guard 10 be adapted for placement on other types or sizes of motors. Any such adaptions and modifications are specifically included within the scope of the present invention.

The propeller guard 10 is formed from a flat elongated rectangular band 11 of metal which has been formed into a multi-angled shape. It is preferred that the metal be aluminum, however, other metals such as stainless steel, or other materials such as wood or plastic may be used. In the preferred embodiment of the invention the aluminum has a length of approximately four feet, a width of approximately four inches and a thickness of approximately one quarter inch. When formed into the band 11, the nominal diameter thereof is preferably approximately one and a half feet.

The attachment plate 18 preferably forms part of the continuous circumference of the band 11 and is preferably of a length of approximately seven inches, with a width of approximately four inches and a thickness of approximately one quarter inch. The attachment plate 18 is preferably bowed slightly (one quarter inch inward) to conform to the curvature of the bottom of the cavitation plate 16 of the motor 13 to which it is to be attached. The attachment plate 18 may be drilled with holes 19, preferably four, each approximately 5/16ths inches in diameter and each located at a corner of the attachment plate 18 approximately three quarters of an inch in from each side forming each corner. The band 11 may be manufactured by casting, or may be formed from one or more plates that are bent to the desired shape and then welded.

Figure 3:
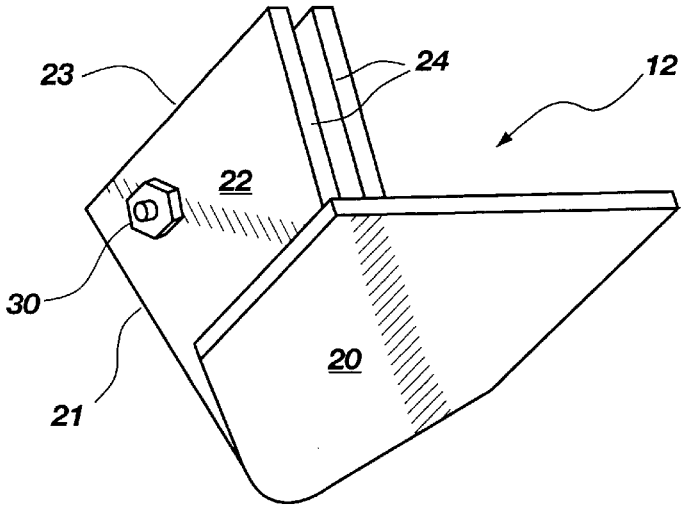
FIG. 3 is a perspective view of the attachment bracket of the present invention taken.

As best shown in FIGS. 2 and 3, the attachment bracket 12 is preferably formed of stainless steel, and in the embodiment of the present invention, is formed of T304 stainless steel. The attachment bracket 12 includes a generally flat, rectangular metal plate 20 preferably approximately one-quarter inch thick, and attached to a pair of side plates 22. The side plates 22 are cut to form front edges 21 which are at an angle (a) of approximately 40 degrees with the top edges 23 thereof. In the preferred embodiment the angle (a) is approximately 38 degrees. The rear edge 24 of side plates 22 is cut to form an angle (b) of approximately sixty degrees with the bottom edge thereof.

The metal plate 20 is attached to the band 11, preferably by welding, at a position diametrically opposed to the center line 25 of the attachment plate 18. The side plates 22 are attached to the metal plate 20 by means of bolts 30.

As best shown in FIG. 2, band 11 includes an inlet opening 32, an outlet opening 33 and a central longitudinal axis 34. From the center line 25 of attachment plate 18, proceeding in both directions around the interior surface 35 of the band 11, ports 36 have been drilled through the band 11 at four inch intervals around its entire circumference. The total preferred number of ports 36 around the band 11 of the particular embodiment shown is twelve. Each port 36 is centered approximately one and one quarter inches back from the inlet opening 32 of the band 11. Each port 36 is drilled through the band 11 at an angle (c) of less than ninety degrees from the central axis 34 of the band 11. It is preferred that the two ports 36 closest to attachment plate 18 be of a diameter of approximately seven tenths of an inch and formed at an angle (c) of approximately thirty-five degrees, with the remaining ports 36 being of a diameter of approximately one-half inch and formed at an angle (c) of approximately twenty degrees.

Figure 4:
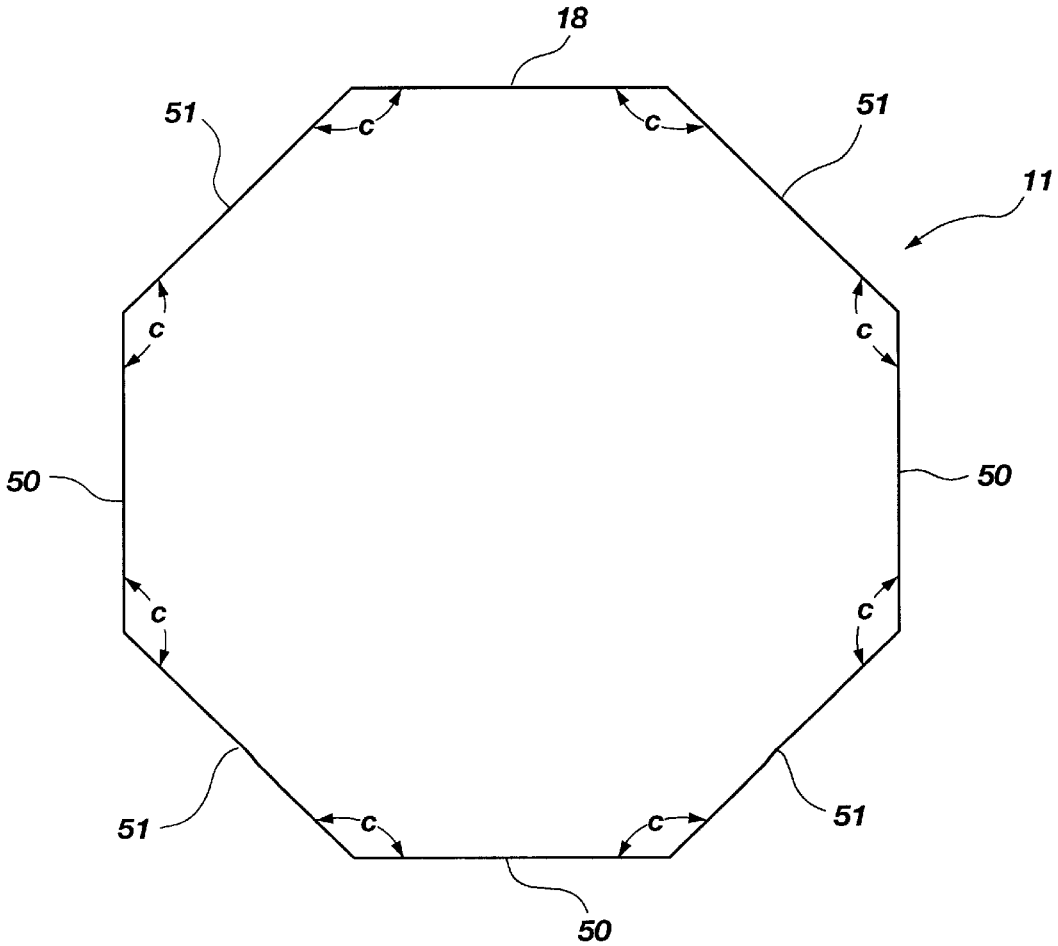
FIG. 4 is a front view of a propeller guard formed in accordance with the principles of the present invention.

As shown in FIG. 4, the band 11 is formed by a plurality of sections joined at each end to form a generally uniform, multi-angled shape. Each of the sections 50 and 51 are formed to a predetermined radius, or formed flat (define as an "infinite radius"). It is not required for the invention as contemplated, for each section 51 to be identical in size and radius, or each section 50 to be identical in size and radius, either to each other section 50 or to the sections 51. It also follows that no requirement for symmetry therefore exist. However, the preferred embodiment of the present invention includes sections 50 and 51 being symmetrical with their counterparts 50 and 51 about a plane passing through the center of attachment plate 18 and attachment bracket 12. The effect of the angles (c) is to cause portions of the band 11 to be positioned closer to the prop blades 15 than other portions, as is readily apparent. During operation, rotation of blades 15 consecutively past each section 50 and 51 causes the water pressure at the blades 15 to fluctuate. This pressure fluctuation effectively allows the water to be "flushed" through the prop guard 10 in a more rapid manner than prior art cylindrical prop guards. Thus water pressure fluctuation effect is generated by the shape of the band 11, and is independent of whether or not the ports 36 are present. In this respect therefore, ports 36 are only an optional part of the present invention and constitute only one possible preferred embodiment thereof.

Figure 5:
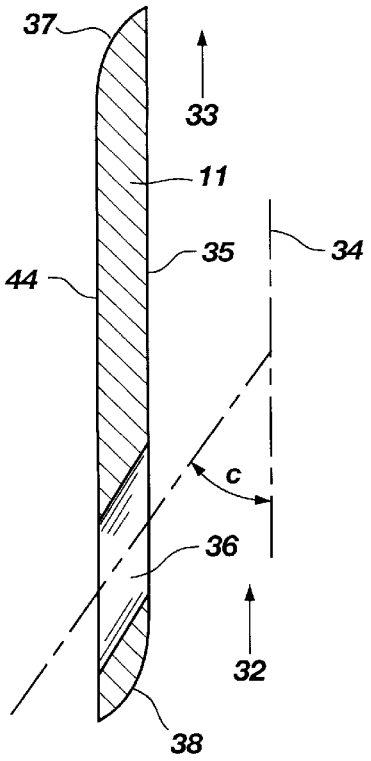
FIG. 5 is a cross-sectional view taken along line V—V of FIG. 2.

As shown in FIG. 5, the interior surface 35 of the band 11, at the inlet opening 32 thereof is formed with a somewhat convex tapered end surface 37. Similarly,the exterior surface 44 of the band 11 at the outlet opening 33 thereof is shaped with a convex taper 38 therein.

The prop guard 10 is attached to the motor 13 by locating attachment plate 18 against the bottom surface of cavitation plate 16 and bolting the attachment plate 18 thereto by bolts 39 passing through openings 19. The side plates 22 are then bolted by bolts 30 to the lower fin 17 of the motor 13. The preferred mounted position of the prop guard 10 locates the plane of the end surface 37 approximately three quarters to one and a half inches beyond the prop 14.

Figure 6:
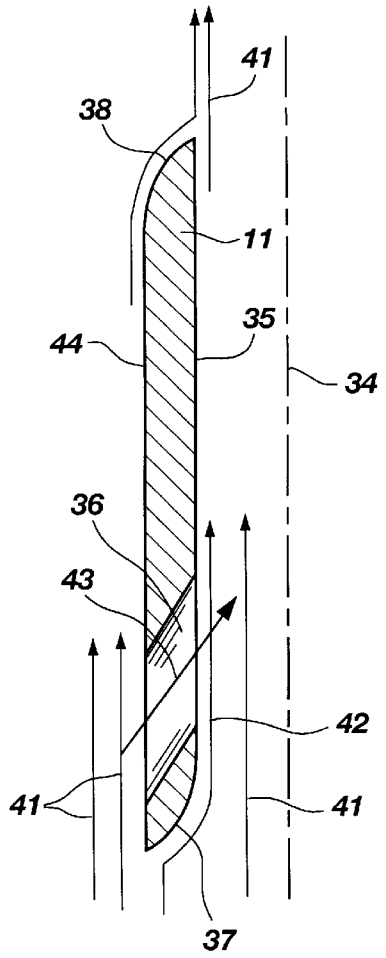
FIGS. 6 and 7 are cross-sectional views similar to FIG. 5 with arrows showing water flow direction.

As best shown in FIG. 6, the prop guard 10 when in operation, is generally oriented to allow water to pass along the longitudinal axis 34 thereof (as shown by lines 41). End surface 37 of band 11 is shaped so as to cause water flowing there against, such as represented by line 42, to be diverted to flow along interior surface 35. Because line 42 has been diverted, as is well known in fluid dynamics, the diversion of water flow as represented by line 42 causes the speed of fluid represented by One 42 to be increased. This in turn causes vacuum effect through ports 36 (if present). The vacuum effect generated in ports 36 causes water to be drawn from the exterior surface 44 of band 11, through ports 36 and into the interior thereof (as shown in flow line 43).

The net effect of surface 37 and ports 36 on the water flowing there past is to draw a portion of the water from the exterior 44 of the band 11 into the interior area of the band 11 where it can impinge upon the propeller 14, thus increasing the thrust capability of the motor 13.

Figure 7:
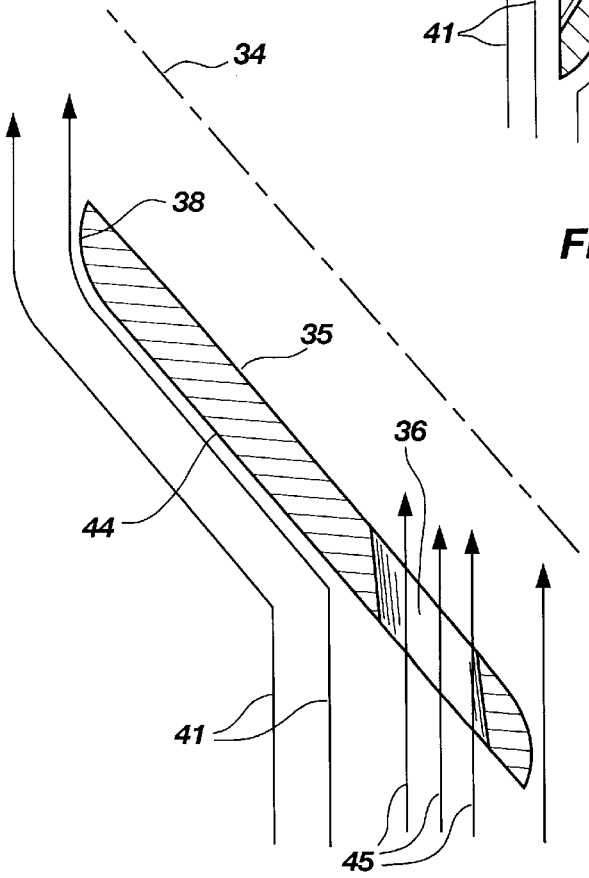

As shown in FIG. 7, when the motor 13 is moving at a velocity through the water, and the propeller is rotated relative to the flow of water in order to effect a turn, it can be seen that water flow lines 41 will impinge upon exterior surface 44 of the band 11, and be diverted over end surface 38. In prior art prop guards, when the propeller is rotated to effect such a turn, water is blocked from the propeller by the exterior surface of the guard. However, in the present invention, rotation of the propeller 14 to effect a turn causes band 11 to orient a plurality of the ports 36 (those ports 36 lying directly in line with the water flow lines 45) to be oriented such that water can flow directly through ports 36 and into the blades 16 of the propeller 14, without interference from the band 11.

Prior art prop guards completely inhibit flow of water directly into the propeller during a turn such as shown by FIG. 7, and therefore cause cavitation in the area of the propeller. The cavitation causes a loss of thrust of the motor which in turn causes a loss of steering control. The design of the present invention, when also including the ports 36, ensures that a flow of water is always directed into the propeller 14, even while effecting sharp turns at high speeds.

Figure 8:
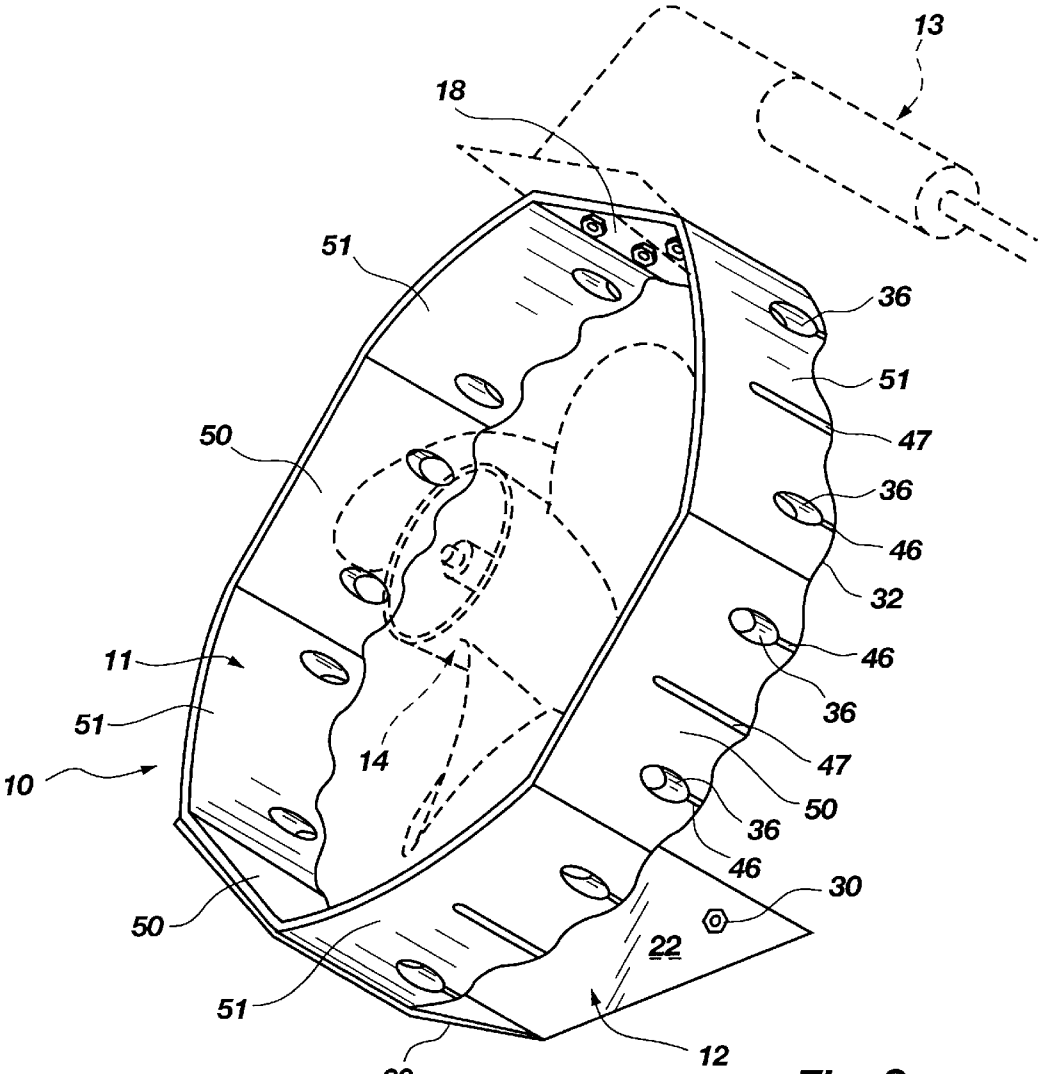
FIG. 8 is a perspective view of an alternative embodiment of the propeller guard of the present invention showing the inlet opening thereof form in a sinusoidal configuration.

As shown in FIG. 8, the inlet opening 32 of the prop guard 10 of the present invention may alternatively be designed to form a sinusoidal surface around the band 11. The sinusoidal shape of the inlet opening 32, as opposed to the generally circular shape thereof as shown in FIG. 2, is additionally intended to assist in lowering the coefficient of drag against the prop guard 10 as it passes through the water during use.

Figure 1:
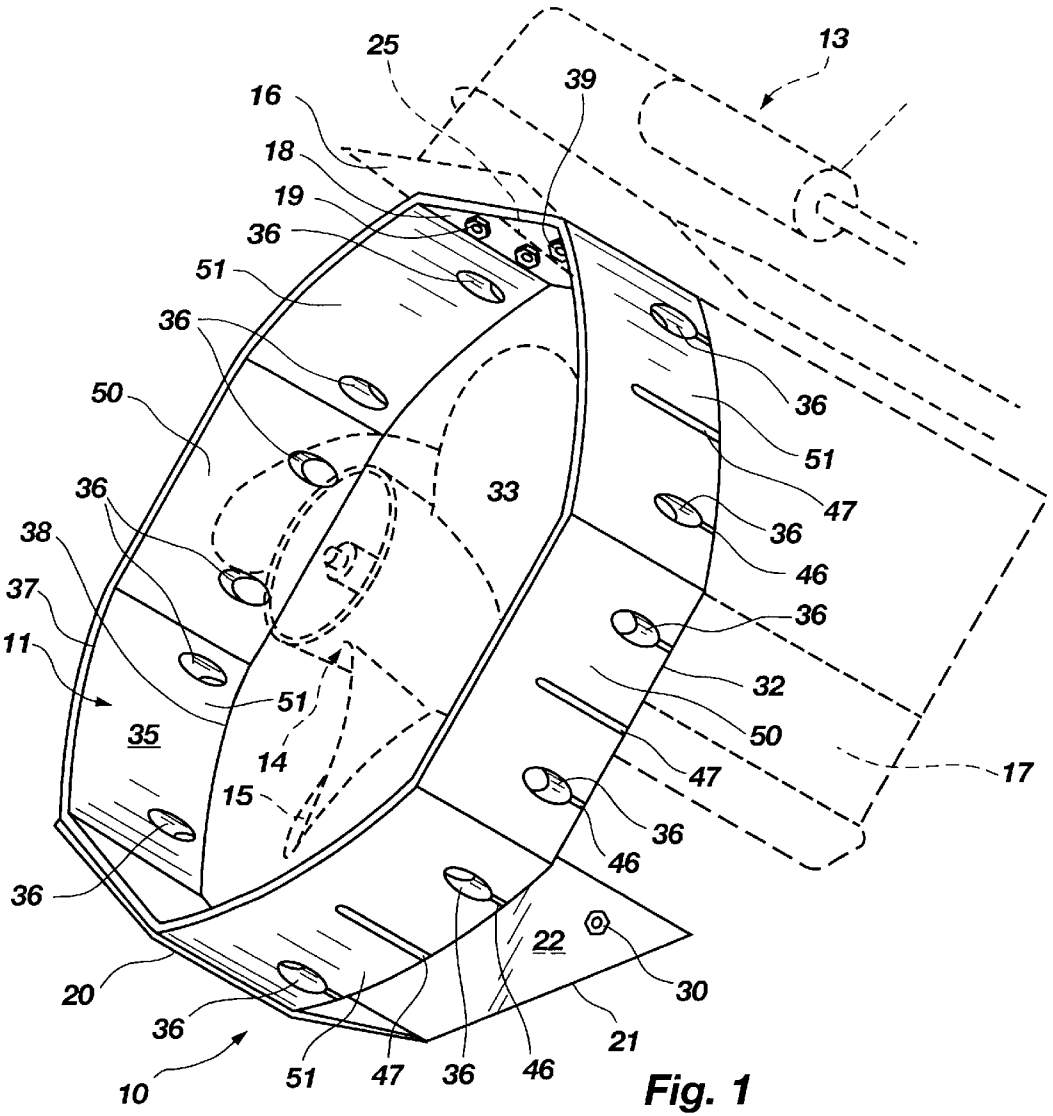
FIG. 1 is a perspective view of a propeller guard formed in accordance with the principles of the present invention, showing the propeller guard attached to an outboard motor (drawn in dashed lines)

As shown in FIGS. 1–2 and 8, if desired, the band 11 may also include a series of grooves 46 located on the exterior surface 44 of the band 11 to extend from the inlet opening 32 into each of the ports 36, such that each groove 46 is oriented parallel to the central longitudinal axis 34. Similar grooves 47 may be located parallel to grooves 46 and spaced between each port 36 to extend either partially or entirely along the exterior surface 44 of the band 11. These grooves 46 and 47 aid in increasing the stability of the guard 10 as it moves through the water, and also, in the case of grooves 46, which can be drawn in through ports 36.

The prop guard of the present invention has been tested to verify the performance characteristics thereof during actual use. In a first test, a 115 hp outboard engine was fitted with a 19 pitch stainless steel propeller. The motor was attached to a boat and run at top speed (with throttle wide open) and reached a speed of 37 mph at 5500 rpms. The prop guard of the present invention was then attached to the motor and the motor was again run to top speed. The top speed of the motor including the prop guard attached thereto was 36 mph at 5250 rpms. The prop guard of the present invention was then removed and replaced with a prior art prop guard. Top speed of the motor with the prior art prop guard attached thereto was 30 mph at 4800 rpm.

A second series of tests were performed using the prop guard of the present invention. In this test, a 115 hp outboard motor with a 15 pitch aluminum prop was fitted with a ring similar to band 11 of the present invention, however without any ports 36 extending therethrough and without any tapering of the front or rear end surfaces 37 and 38 thereof. The motor was run at full throttle and reached 29 mph at 5000 rpms.

Next, the band 11 was tapered at the rear end surface 38 thereof, in the manner as described in the disclosure, and the motor was again run at full throttle. The motor reaches 30 mph at 5300 rpms.

Next, the band 11 was tapered at the front end 37 thereof, and the motor was run at full throttle. The motor reached 32 mph at 5000 rpms.

Next, the ports 36 were drilled in the ring 11 at the angle as described above in the disclosure, and the motor was again run at full throttle. The motor reaches 34 mph at 5750 rpms. The prop guard was then completely removed from the motor and the motor was run at full throttle and reached a speed of 35 mph at 5750 rpms.

A third test was conducted to determine the period of time necessary to cause the boat to come to a level position from a starting position dead in the water, to an ending point at top speed. Using a 19 pitch stainless prop with the 115 hp outboard motor, and the prop guard 10 of the present invention, the average time to level the boat was 15 seconds. Without the prop guard 10, the average time to level the boat was 17.6 seconds. The test therefore showed that the prop guard 10 of the present invention helped the boat come to a level position more quickly than without its use. This is important because the boat operators visibility is impaired until the boat reaches a level position. Further, a quicker leveling of the boat allows the boat to be used to pull water skiers with greater ease.

As has also been shown there is very little power loss with the prop guard 10 of the present invention attached to the motor 13. Further, the control and handling of the boat with the prop guard 10 of the present invention is easier since cavitation is greatly reduced or eliminated, especially during hard turns.

In actual use, there have been other noted advantages of the present invention. For example in very choppy water, the prop guard 10 eliminates keel waking, thereby aiding in keeping the boat under control. Also, as shown by the tests above, with the use of the present invention it is possible to achieve similar top speeds from either a 15 pitch propeller or a 19 pitch propeller. This allows the use of a lower pitch prop (which has the advantages of higher power when accelerating from a dead stop) yet allows the prop nevertheless to retain a good top end speed (such as is generally the purpose of a higher pitched prop). In other words, use of the prop guard of the present invention allows a lower pitched prop to take on the characteristic of a more elaborate (and expensive) two speed prop.

It is to be understood that the above described embodiment is only illustrative of the application of the principles of the present invention. Numerous modifications or alternative arrangements or embodiments may be devised by those skilled in the art without departing from the spirit and scope of the present invention.

What is claimed is:

1. A propeller guard useful in combination with a boat motor, said propeller guard comprising:

a single band having eight angles for surrounding a propeller of the motor, said band including an interior surface and an exterior surface and defining a single inlet opening and an outlet opening, said band further defining eight sections, each of said sections adjoining an adjacent section at an angle, said inlet opening being positioned entirely within a single plane.

2. A propeller guard according to claim 1 wherein said band includes a plurality of ports formed therein and spaced there around, said plurality of ports allowing fluid flow between said exterior and interior surfaces.

3. A propeller guard according to claim 2 wherein said band defines a longitudinal axis therethrough and each of said plurality of ports is generally cylindrical in shape and defines its own longitudinal axis, and whereby said longitudinal axes defined by each of said plurality of ports intersects said longitudinal axis defined by said band at an angle of less than 90 degrees, whereby, movement of said propeller guard through a fluid such that fluid enters said inlet opening and exits said outlet opening thereof, causes fluid impinging on said convex tapered portion of said interior surface to be diverted along said interior surface and to be accelerated in speed relative to fluid flowing along said exterior surface, thus causing a vacuum effect which draws fluid through said plurality of ports into said band.

4. A propeller guard according to claim 1, further including an attachment bracket for attaching said propeller guard to the motor.

5. A propeller guard according to claim 4, wherein said propeller guard further includes an attachment plate which is formed as an integral part of said band, and which is located at a position diametrically opposed to said attachment bracket.

6. A propeller guard according to claim 5, wherein said attachment plate is slightly concave.

7. A propeller guard according to claim 1, wherein said band defines a longitudinal axis therethrough and wherein said exterior surface and said interior surface are substantially parallel with said longitudinal axis defined by said band.

8. A propeller guard according to claim 1 wherein said predetermined radius of at least one of said plurality of sections is an infinite radius such that said at least one section is flat.

9. A propeller guard according to claim 1 wherein said plurality of sections includes a first plurality of sections having a first predetermined radius and a second plurality of sections having a second predetermined radius which is different from said first predetermined radius.

10. A propeller guard according to claim 1 wherein said interior surface at said inlet opening forms a convex taper.

11. A propeller guard according to claim 2 wherein the plurality of ports are uniformly spaced around the propeller guard.

12. A propeller guard according to claim 1, wherein at least a portion of said sections are flat, and at least another portion of said sections are curved.

13. A propeller guard according to claim 1, wherein the sections are disposed in a configuration alternating between flat and curved sections.

14. A propeller guard according to claim 1, wherein said sections are flat.

15. A propeller guard according to claim 1, wherein the sections are of approximately equal size.

16. A propeller guard useful in combination with a boat motor, said propeller guard comprising:

a multi-angled band for surrounding a propeller of the motor, said band including an interior surface and an exterior surface and defining an inlet opening and an outlet opening, said band further defining a plurality of sections, and wherein said inlet opening is sinusoidal.

17. An octagon-shaped propeller guard for use with a boat motor propeller, said propeller guard comprising:

a single band sized and configured to surround said propeller having eight substantially flat sections being joined at eight joints, said band defining an inlet opening and an outlet opening.

18. An octagon-shaped propeller guard according to claim 17, wherein said band defines an interior surface and an exterior surface and includes a plurality of ports formed therein and spaced there around, said plurality of ports allowing fluid flow between said exterior and interior surfaces.

19. An octagon-shaped propeller guard according to claim 17, further comprising an attachment bracket for attaching the propeller guard to the motor.

20. An octagon-shaped propeller guard according to claim 17, wherein the propeller guard contains a single inlet opening and a single outlet opening.

* * * * *